United States Patent [19]

Lockey

[11] 4,177,593

[45] Dec. 11, 1979

[54] DEVICE HAVING INDICIA ANNOUNCING AN EVENT

[76] Inventor: James E. Lockey, 4912 Upton Ave. S., Minneapolis, Minn. 55410

[21] Appl. No.: 874,341

[22] Filed: Feb. 1, 1978

[51] Int. Cl.[2] ..... G09F 3/00; G09F 23/06

[52] U.S. Cl. ..... 40/488; 40/2 F; 40/491; 206/457; 229/71

[58] Field of Search ..... 40/486, 488, 491, 538, 40/539, 124.1, 2 F, 2 R, 10 R, 16, 19; 206/457, 458, 459; 229/87 F, 87 R, 71; 116/135, 321

[56] References Cited

U.S. PATENT DOCUMENTS

| | | | |
|---|---|---|---|
| 1,628,121 | 5/1927 | Covel | 206/457 |
| 2,033,998 | 3/1936 | Prager | 206/459 |
| 2,335,713 | 11/1943 | Vogel | 40/491 |
| 3,696,540 | 10/1972 | Ortega | 40/538 |
| 4,054,242 | 10/1977 | Strobe | 40/124.1 |

*Primary Examiner*—John F. Pitrelli
*Attorney, Agent, or Firm*—Wicks & Nemer

[57] ABSTRACT

A device having indicia announcing an event including an edible item having indicia thereon which includes as part of the indicia the letters "SHE". A walled sleeve includes an opening in the wall thereof of a size when positioned on the item exposes only the letters "SHE" or "HE" of the indicia. The sleeve includes complementary indicia such as "IT'S A" adjacent the opening of the sleeve whereby the only indicia appearing on the item is "IT'S A SHE" when the letters "SHE" are exposed or "IT'S A HE" when the letters "HE" are exposed.

5 Claims, 12 Drawing Figures

DEVICE HAVING INDICIA ANNOUNCING AN EVENT

SUMMARY

The invention relates to an improvement in devices for announcing an event. When a baby is born, it has been a practice of long standing by many, and in particular the father, to give away a cigar to announce the birth event. The wrapper of the cigar usually carried the indicia as "It's A Girl" or "It's A Boy." Of late, smoking has become rather unpopular with many persons, both with respect to a person who might receive a cigar as above as well as one who gives the cigar.

It is an object of the invention to provide an announcement device in combination with an edible item, for example, a candy bar having indicia in the form of a trade-mark "HERSHEY'S" on the wrapper thereof together with a sleeve that slips on over the wrapper, the sleeve having an opening on the flat side wall thereof which allows only the letters "SHE" of the mark "HERSHEY'S" to be exposed. On the sleeve is complementary indicia such as "IT'S A" whereby the announcement message viewed on the side of the sleeve is "IT'S A SHE". On the opposite side wall of the above sleeve or on a further sleeve is formed an opening on the flat side wall thereof which allows only the letters "HE" of the mark "HERSHEY'S" to be exposed when the sleeve is slipped onto the candy bar. The sleeve also includes thereon the indicia "IT'S A" whereby the announcement message viewed on the side of the sleeve is "IT'S A HE". Other trademarks may be used, portions of which are viewed through an opening of a sleeve as above to provide an announcement. Other complementary indicia may be used such as "Happiness Is A Newborn."

In the drawings forming part of this application:

Figure 2:
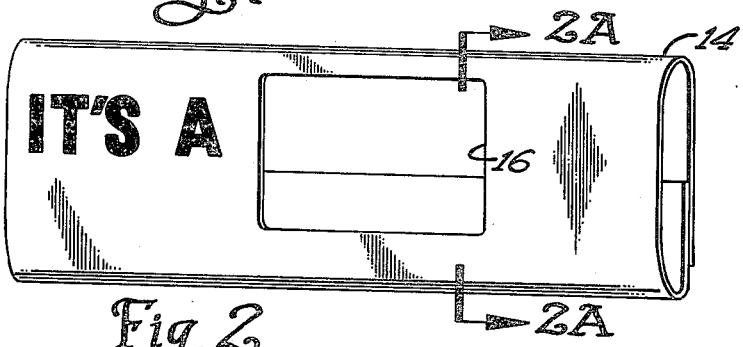
FIG. 2 is an elevational view of a sleeve having an opening for mounting on the bar of FIG. 1 and embodying the invention.
Figure 2A:
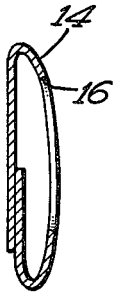

FIG. 2*a* is a sectional view on the line 2*a*—2*a* of FIG. 2.

Figure 1:
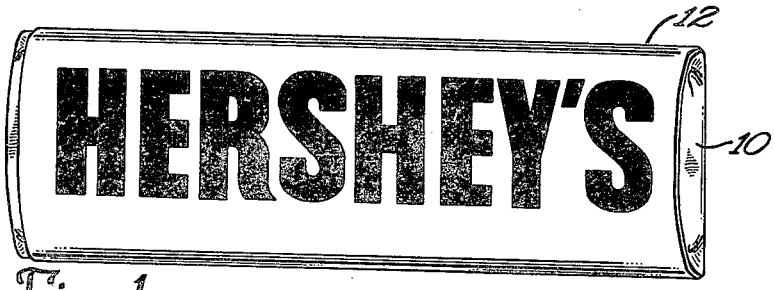
FIG. 1 is an elevational view of candy bar with wrapper having the trademark Hershey's thereon.
Figure 3:
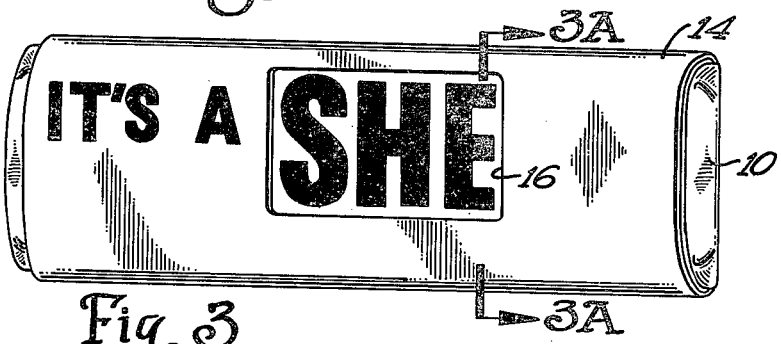
Figure 3A:
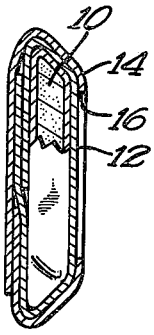

FIG. 3 is an elevational view of the sleeve of FIG. 2 in operative position on the bar of FIG. 1 and embodying the invention.

Figure 4:
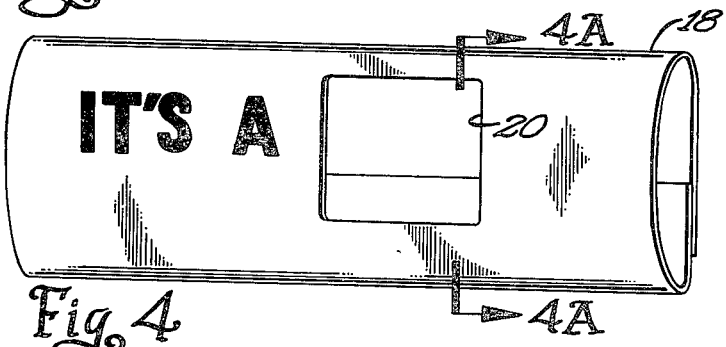

FIG. 4 is an elevational view of a further embodiment of the sleeve of FIG. 2.

Figure 4A:
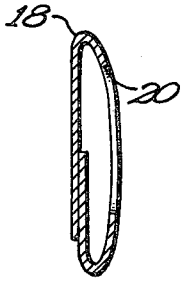

FIG. 4*a* is a sectional view on the 4*a*—4*a* of FIG. 4.

Figure 5:
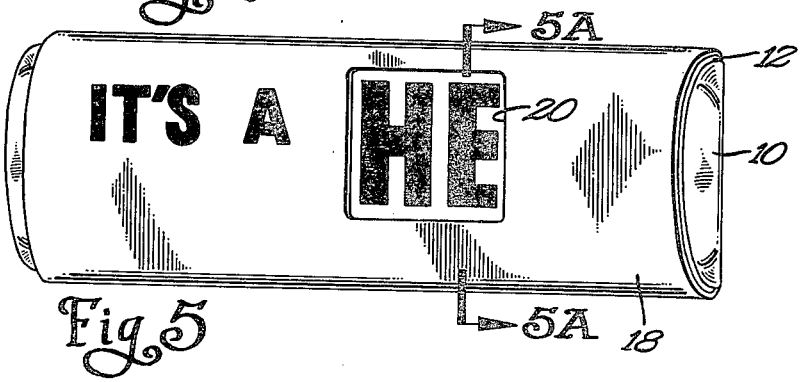

FIG. 5 is an elevational view of the sleeve of FIG. 4 in operative position on the bar of FIG. 1 and embodying the invention.

Figure 5A:
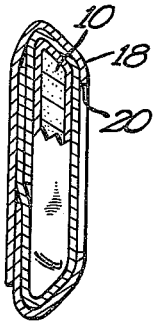

FIG. 5*a* is a sectional view on the line 5*a*—5*a* of FIG. 5.

Figure 6:
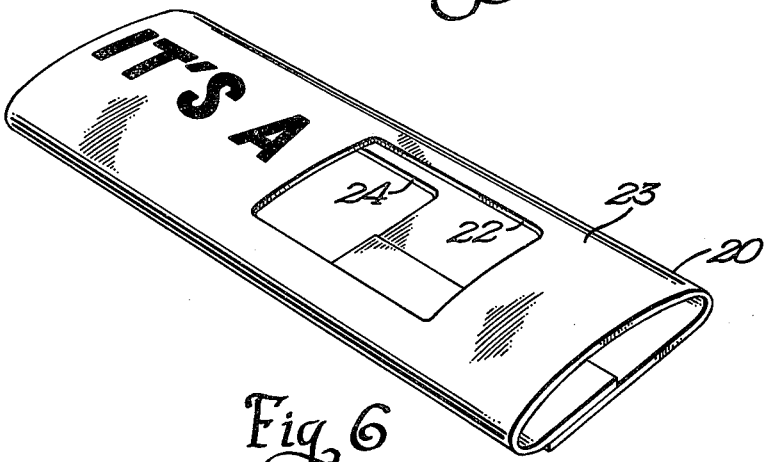

FIG. 6 is a perspective view of a further embodiment of the sleeve.

Figure 7:
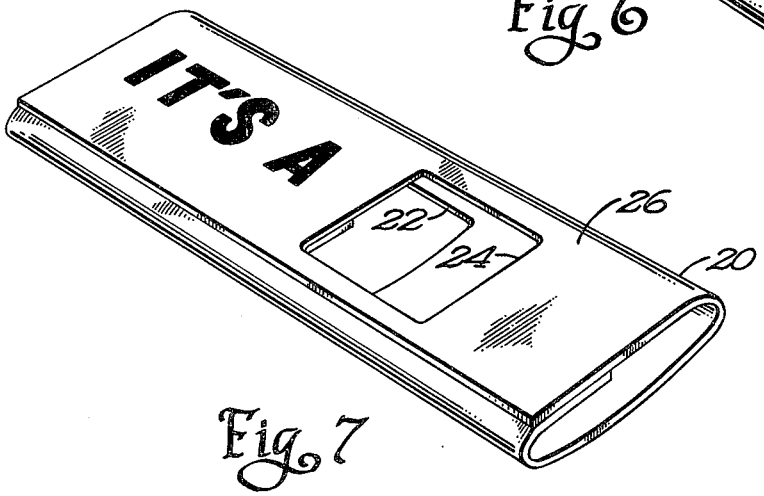

FIG. 7 is a perspective view of the reverse side of the sleeve of FIG. 6.

Figure 8:
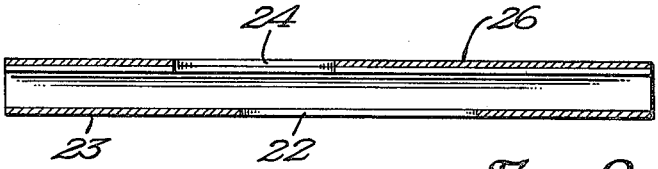

FIG. 8 is a longitudinal sectional view through the the sleeve of FIG. 7.

Referring to the drawings in detail, FIG. 1 illustrates a flat type candy bar 10 with the wrapper 12 mounted thereon and with the trademark indicia "HERSHEY'S" imprinted thereon. Further provided is the sleeve 14 which has formed therein the opening 16 so aligned thereon that when the sleeve is slipped onto this candy bar 10 and over the wrapper 12, the opening 16 allows only the selected letters "SHE" of the wrapper to appear within the opening and with the rest of the sleeve 14 covering the other letters of the trademark "HERSHEY'S." Imprinted on the sleeve 12 is the complementary indicia "IT'S A" to one side of the opening so that the indicia appearing in toto is, "IT'S A SHE."

In FIG. 4 of the drawings is illustrated a further sleeve 18 for use with the same candy bar 10 and wrapper 12 thereon. The sleeve 18 has formed therein the opening 20 so aligned thereon that when the sleeve is slipped onto the candy bar 10 and over the wrapper 12 the opening 20 allows only the selected letters "HE" of the wrapper to be visible within the opening and with the rest of the sleeve 18 covering the other letters of the trademark "HERSHEY'S". Imprinted on the sleeve 18 is the indicia "IT'S A" to one side of the opening so that the indicia appearing in toto is "IT'S A HE."

A further embodiment of the invention illustrated in FIGS. 6 and 7 includes the single sleeve 20 with the opening 22 formed on the side 23 thereof identical to opening 16 and with the opening 24 formed on the opposed side 26 of the sleeve, the opening 24 identical to the opening 20 of the sleeve 18. The single sleeve 20 may be used to display the letters "SHE" by using the opening 22 on side 23 or may be used to display the letters "HE" by using the opening 24 on the side 26 by simply reversing the sleeve 20 side to side.

Having thus described the invention, what is claimed as new and desired to be secured by Letters Patent is:

1. A device for announcing an event comprising in combination:

(a) an edible item having letter indicia thereon which includes as part of the indicia the letters "SHE,"

(b) a walled sleeve having an opening in the wall thereof of a size which when positioned on the item exposes only the letters "SHE" of the indicia, (c) said sleeve having complementary indicia adjacent said opening whereby the only indicia appearing relative to the item is the complementary indicia and the letters "SHE."

2. The device of claim 1 in which said sleeve includes (a) a further opening in the wall thereof of a size which when positioned on the edible item exposes only the letters "HE" of the indicia, (b) said sleeve having complementary indicia adjacent said further opening whereby the only indicia appearing relative to the sleeve is the complementary indicia and the letters "HE."

3. A device for announcing an event comprising in combination:

(a) a candy bar having thereon the indicia "HERSHEY'S,"

(b) a sleeve having an opening in the wall thereof of a size which when positioned on the candy bar exposes only the letters "SHE" of the indicia "HERSHEY'S,"

(c) said sleeve having indicia as "IT'S A" adjacent said opening whereby the only indicia appearing relative to the sleeve is "IT'S A SHE."

4. The device of claim 3 in which the sleeve includes (a) a further opening in the wall thereof of a size which when positioned on the candy bar exposes only the letters "HE" of the indicia "HERSHEY'S,"

(b) said sleeve having indicia "IT'S A" adjacent said further opening whereby the only indicia appearing relative to the sleeve is "IT'S A HE."

5. A device for announcing an event comprising in combination:

(a) an edible item having letter indicia thereon which includes as part of the indicia the letters "HE,"

(b) a sleeve having an opening in the wall thereof of a size which when the sleeve is positioned on the item, the opening exposes only the letters "HE" of the indicia, (c) said sleeve having indicia adjacent said opening complementary to the exposed letters "HE."

* * * * *